US008270858B2

(12) United States Patent
Lee

(10) Patent No.: US 8,270,858 B2
(45) Date of Patent: Sep. 18, 2012

(54) IMAGE FORMING DEVICE TO DETERMINE PAPER WIDTH AND IMAGE FORMING METHOD THEREOF

(75) Inventor: Ui-choon Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 858 days.

(21) Appl. No.: 11/953,196

(22) Filed: Dec. 10, 2007

(65) Prior Publication Data

US 2008/0152368 A1 Jun. 26, 2008

(30) Foreign Application Priority Data

Dec. 22, 2006 (KR) ..... 10-2006-0133109

(51) Int. Cl.
*G03G 15/00* (2006.01)

(52) U.S. Cl. ..... 399/45; 399/405

(58) Field of Classification Search ..... 399/45, 399/405

See application file for complete search history.

(56) References Cited

U.S. PATENT DOCUMENTS 5,289,247 A * 2/1994 Takano et al. ..... 399/45
5,331,384 A * 7/1994 Otsuka ..... 399/45

FOREIGN PATENT DOCUMENTS

JP 62046843 A * 2/1987
JP 63218471 A * 9/1988
JP 2000098794 A * 4/2000

* cited by examiner

*Primary Examiner* — David Gray
*Assistant Examiner* — Erika J Villaluna
(74) *Attorney, Agent, or Firm* — Stanzione & Kim, LLP

(57) ABSTRACT

An image forming device includes a sensor to detect whether a paper is discharged or not, a determiner to determine a paper width according to whether a sensing signal is output from the sensor when a printing job is executed, and a controller to control a subsequent printing operation according to the determination result of the determiner. After the printing job is initiated, the determiner determines a normal width when the sensing signal is output within a preset time, and the determiner determines a narrow width when the sensing signal is not output within the present time. Accordingly, using an existing sensor, the paper width can be detected and the appropriate printing process can be performed.

15 Claims, 5 Drawing Sheets

IMAGE FORMING DEVICE TO DETERMINE PAPER WIDTH AND IMAGE FORMING METHOD THEREOF

CROSS-REFERENCE TO RELATED APPLICATIONS

This application claims the benefit under 35 U.S.C. §119 (a) from Korean Patent Application No. 2006-133109 filed on Dec. 22, 2006, in the Korean Intellectual Property Office, the disclosure of which is incorporated herein in its entirety.

BACKGROUND OF THE INVENTION

1. Field of the Invention

The present general inventive concept relates generally to an image forming device and an image forming method thereof. More particularly, the present general inventive concept relates to an image forming device to detect a width of a paper using a sensor to detect whether the paper is discharged and to control a subsequent printing operation according to the detection result, and an image forming method thereof.

2. Description of the Related Art

With the advancement of electronic technology, a variety of computer peripheral devices have been developed. Representative peripheral devices include image forming devices such as printers, copiers, fax machines, and multifunction peripherals.

The image forming devices are used in offices as well as at home. Users can perform a variety of printing applications such as creating calendars, photos, and business cards, using the various functions readily available in the image forming devices.

With regard to the printing applications of printing photos and business cards, the size of the printing papers used for the various printing applications may differ from the normal paper size (e.g., A4 paper size). Thus, it is preferable to set a printing condition (i.e., requirements for printing the applications) taking into account the printing paper size. When the user sets a printing paper size in a printer driver program, the image forming device executes a printing command by applying the printing condition that is suitable for the selected printing paper size. An example of the various printing conditions include: printing speed, a fuser temperature, or a fuser pressure.

However, when the user does not select the printing paper size, the image forming device executes the printing command using a default printing condition. For instance, the printing condition associated with A4 paper is applied to papers having a smaller size than the A4 paper size. In this case, the size difference between the actual printing paper size and the default A4 printing paper size may cause damage to the components. For example, with a fusing heat roller, there is generally a thermal difference between the paper contact portion and the paper non-contact portion on the roller surface because the heating temperature in the paper contact portion decreases due to the paper temperature. As a result, the roller surface under a great amount of heat may be damaged due to temperature changes. Consequently, the printing quality may be degraded.

Conventional image forming devices also apply printing conditions based on the type or size of the printing papers by using a paper length sensor. However, these conventional image forming devices cannot apply proper printing conditions with respect to printing papers having non-standard printing paper sizes. For instance, when the A4 paper is folded or cut lengthwise, the paper length sensor merely detects the length, not that the paper has been cut lengthwise, and recognizes the paper as being general A4 paper. Hence, the conventional image forming devices will execute the printing operation by applying the A4 paper printing condition. As discussed above, component damage may result.

Additionally, when a paper width sensor is provided to sense the paper width, additional cost associated with the addition thereof is inevitable.

SUMMARY OF THE INVENTION

The present general inventive concept provides an image forming device which can sense a paper width using an existing sensor without an additional structure and prevents component damage and printing quality degradation by applying a printing condition according to the sensing result.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming device including a sensor to detect whether a paper is discharged, a determiner to determine a paper width according to whether a sensing signal is output from the sensor when a printing job is executed, and a controller to control a subsequent printing operation according to a determination result of the determiner.

After the printing job is initiated, the determiner may determine the paper to have a normal width when the sensing signal is output within a preset time, and the determiner may determine the paper to have a narrow width when the sensing signal is not output within the present time.

The image forming device may further include a delivery sensor which is disposed at a delivery path of the paper to detect whether the paper is delivered from a paper tray, wherein the determiner determines a normal width of the paper when the sensing signal is output within a preset time from a time point when a delivery sensing signal is output from the delivery sensor, and the determiner determines a narrow width of the paper when the sensing signal is not output within the preset time.

The controller may maintain a print speed, a fuser temperature, and a fuser pressure as default values when the determiner determines a paper width is a normal width, and the controller may execute the subsequent printing by decreasing at least one of the print speed, the fuser temperature, and the fuser pressure to a preset value when the paper width is determined to be the narrow width.

The image forming device may further include a discharger to discharge a printed paper, wherein the sensor is disposed at one side of the discharger, the sensor outputs the sensing signal upon being touched by a normal width paper, which is discharged from the discharger, and the sensor is not touched by a narrow paper, which is discharged from the discharger.

The foregoing and/or other aspects and utilities of the present general inventive concept may also be achieved by providing an image forming method of an image forming device having a sensor to detect whether a paper is discharged, including determining a paper width according to whether a sensing signal is output from the sensor when a printing job is executed, and executing a subsequent printing operation according to the determination result.

After the printing job is initiated, the determining of a paper width may determine a normal width when the sensing signal is output within a preset time and may determine a narrow width when the sensing signal is not output within the preset time.

The determining of a paper width may determine a normal width when the sensing signal is output within a preset time from a time point when a delivery sensing signal is output from a delivery sensor which is disposed in a delivery path of the paper to detect whether the paper is delivered, and may determine a narrow width when the sensing signal is not output within the present time.

The executing of a subsequent printing operation may maintain a print speed, a fuser temperature, and a fuser pressure as default values when the normal width is determined, and execute the subsequent printing by decreasing at least one of the print speed, the fuser temperature, and the fuser pressure to a preset value when the narrow width is determined.

The foregoing and/or other aspects and utilities of the present general inventive concept may also be achieved by providing an image forming device, including a sensor to sense a width of a recording medium being discharged from a predetermined point within the image forming device, and a controller to selectively adjust subsequent printing conditions in response to the sensed width of the recording medium.

The sensor may include a touch lever to move according to a width of the recording medium; and a sensing part to sense when the touch lever has moved The first width result may be determined based upon the expiration of a predetermined time duration, the predetermined time duration being calculated from a point when the delivery sensing signal is output from the delivery sensor.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
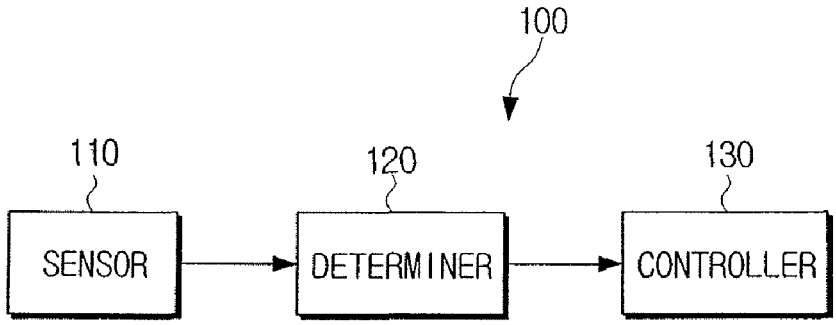
FIG. 1 is a block diagram illustrating an image forming device according to an embodiment of the present general inventive concept.

Reference will now be made in detail to embodiments of the present general inventive concept, examples of which are illustrated in the accompanying drawings, wherein like reference numerals refer to the like elements throughout. The embodiments are described below to explain the present general inventive concept by referring to the figures.

FIG. 1 is a block diagram illustrating an image forming device according to an embodiment of the present general inventive concept. The image forming device 100 includes a sensor 110, a determiner 120, and a controller 130. The image forming device 100 can be a printer, a copier, a fax machine, or a multifunction processor.

The sensor 110 is disposed at a predetermined location of the image forming device 100 from which papers 10 are discharged, so that the discharged papers may touch the sensor 110. Accordingly, the sensor 110 outputs a sensing signal in response to the papers 10 being discharged from a location of the image forming device 100. The sensor 110 can be a bin full sensor to detect whether a paper output tray is full. Additionally, the sensor 110 can be an output bin sensor or a stacker sensor. The above listed sensors are provided merely as examples, and the general inventive concept is not limited thereto.

The determiner 120 determines whether the paper width is a normal width (i.e., 210 mm) or a narrow width (i.e., less than 210 mm) based upon the sensing result of the sensor 110. in particular, when a sensing signal is output from the sensor 110, the paper width is determined to be a normal width. However, when no sensing signal is output by the sensor 110, the determiner determines the paper width to be a narrow width paper.

The controller 130 controls a subsequent printing operation according to the width determination result of the determiner 120. For example, when the width of the paper 10 is determined to be a narrow width paper, the controller 130 controls a printing module (not illustrated) to execute a subsequent printing operation that applies a printing condition for the narrow width paper. Examples of the above referenced printing conditions can include a printing speed, a fuser temperature, or a fuser pressure, however, the present general inventive concept is not limited thereto, and other printing conditions known in the art may be employed. An example of the above-described subsequent printing operation is reducing a current print speed of the image forming device 100 from 30 pages per minute (ppm) to 20 ppm. An additional example would be if the current fuser temperature is 190° C., the controller 130 would reduce the fuser temperature to 170° C. Likewise, by lowering the fuser pressure, the printing can be performed. Accordingly, the component damage can be prevented in advance by reducing the thermal difference between a paper contact portion of a fusing unit and a paper non-contact portion of a fusing unit. For example, where a heater fuser roller and a non-heated fuser roller are used in a fusing unit, the thermal difference between the two rollers can be reduced. Other than the adjustment of the print speed, the fuser temperature, and the fuser pressure, the controller 130 may employ other known processes of narrow-width paper processing.

As discussed above, when the sensor 110 outputs a sensing signal in response to a paper 10 being discharged from a predetermined location, the paper 10 width is determined to be a normal width paper. When the paper width is determined to be a normal width paper, the subsequent printing operation can be executed using default values. Different default values can be preset in the printer driver program according to the type of printing papers selected.

Alternatively, as also discussed above, when the sensor 110 does not output a sensing signal in response to a paper 10 being discharged from the predetermined location, the width of the paper 10 is determined to be a narrow width paper. In particular, if the sensing signal is not output within a preset time (i.e., a set reference time) from the beginning of the printing job, the determiner 120 determines that the narrow width paper is to be printed. The reference time can be set by taking into account an average printing time of the image forming device 100. For instance, if the image forming apparatus generally takes approximately 10 seconds to print a sheet of paper 10, a reference time can be set ranging from 12~13 seconds.

The determiner 120 counts the elapsed time with respect to the reference time by recognizing various time points as printing job execution time points, which will be discussed in further detail below with reference to FIG. 3. A few examples of printing job execution time points may include a time point when a print command is received from a host PC (not illustrated), a time point when a video controller (not illustrated) of the image forming device 100 issues a print command to an engine controller (not illustrated), and a time point when an actual printing module (not illustrated) is driven. Thus, taking into account the amount of time for each function performed when the print job is executed can provide an estimation of the time that has elapsed since the start of the print job.

Figure 2:
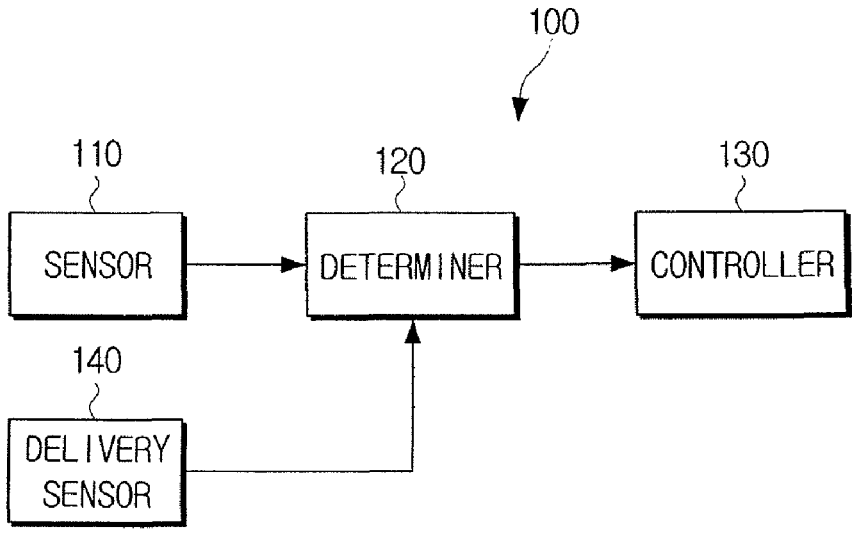
FIG. 2 is a block diagram illustrating an image forming device according to another embodiment of the present general inventive concept.

FIG. 2 is a block diagram illustrating an image forming device 100 according to another embodiment of the present general inventive concept. The image forming device 100 of FIG. 2 includes a sensor 110, a determiner 120, a controller 130, and a delivery sensor 140.

The delivery sensor 140 is disposed at a paper delivery path of the image forming device 100 to detect paper delivery from a paper tray 170. The delivery sensor 140 can be a feeding sensor to detect whether papers are fed from a paper tray (not illustrated), however, the present general inventive concept is not limited thereto, and any sensor that can perform the intended operations described herein may be used.

When a sensing signal is not output from the sensor 110 within a preset time from the time point when the paper 10 is detected at the delivery sensor 140, the determiner 120 can determine the width of the paper to be a narrow width paper. Accordingly, the controller 130 proceeds with a subsequent printing operation that corresponds to the narrow width paper by adjusting the printing condition.

Alternatively, when the sensing signal is output from the sensor 110, the determiner 120 determines the width of the paper to be a normal width paper. Hence, the controller 130 performs a subsequent printing function by applying the paper based printing operation set in the printer driver program. That is, by applying the default values stored in the printer driver program.

As in FIG. 1, the preset time for the determination basis regarding the embodiment of FIG. 2 can be set by taking into account an average printing time of the image forming device 100. For instance, if the paper 10 is estimated to be output to the delivery path 30 within a timeframe of 2~5 seconds after the paper 10 is detected at the delivery sensor 140, the preset time can be set to 5 seconds.

Figure 3:
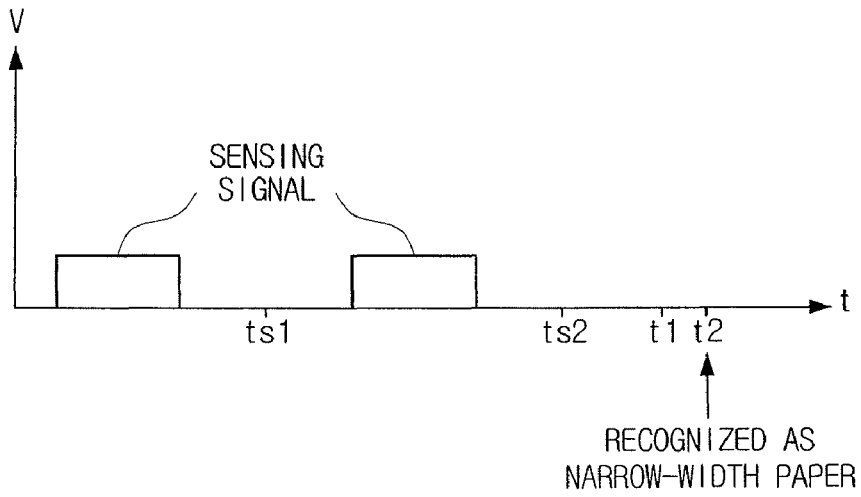
FIG. 3 is a diagram illustrating a sensing signal waveform output from a sensor of the image forming device in accordance with the embodiment of FIG. 1.

FIG. 3 is a diagram illustrating a sensing signal waveform output from the sensor 110 of the image forming device 100 of the embodiments illustrated in FIGS. 1 and 2. Referring to FIG. 3, the sensor 110 maintains a low pulse sensing signal and outputs a high pulse sensing signal when the paper 10 contacts the sensor 110.

Referring to FIG. 3, if the normal printing operation (i.e., a printing operation corresponding to a paper having normal width) is in progress, the high pulse sensing signal should be output at time t1 but is not illustrated as being output in FIG. 3. However, if the high pulse sensing signal is not output until a certain time t2-t1 passes or not even after the certain time t2-t1 passes, the determiner 120 determines that the narrow width papers are being used.

The determiner 120 counts an elapsed time based on the time points ts1 and ts2, which represent time points when the delivery sensing signal is output from the delivery sensor 140. In particular, when the low pulse sensing signal is output consistently until the time t2-ts2 passes, starting from the time ts2, the determiner 120 determines that the narrow width papers are being used.

Figure 4:
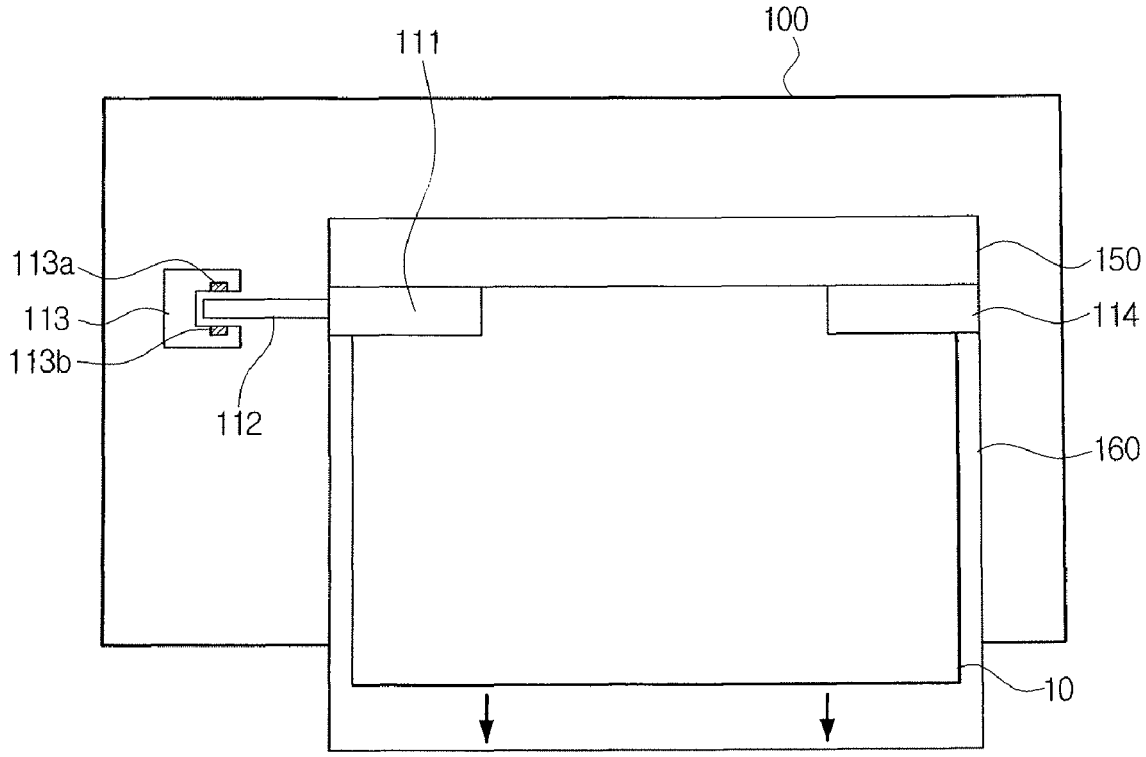
FIGS. 4 and 5 are diagrams illustrating an arrangement of the sensor of the image forming device of FIG. 1 in accordance with the present general inventive concept.

FIG. 4 is a diagram illustrating an arrangement of the sensor 110 disposed in the image forming device 100 of the embodiment of FIG. 1. The sensor 110 includes a touch lever 111, a sensor lever 112, and a sensing part 113.

The printed paper 10 is output through a discharger 150 of the image forming device 100 and stacked on a paper output tray 160.

The sensing part 113 can be a photo sensor which is essentially constructed by combining a light emitting diode (LED) 113*a* and a photo diode 113*b*. The sensor 110 operates such that when the papers 10 are not discharged from the discharger 150, a light radiated from the LED 113*a* is blocked by the sensor lever 112 and is not received at the photo diode 113*b*.

When a paper is discharged from the discharger 150, the paper 10 contacts the touch lever 111. Accordingly, the touch lever 111 is lifted in a vertical direction from the paper surface. The sensor lever 112 is also lifted up together in conjunction with the touch lever 111. As a result, the LED light blocked by the sensor lever 112 is received at the photo diode 113*b*. The photo diode 113*b* then outputs a sensing signal. When the paper 10 is completely discharged and is dropped onto the paper output tray 160, the touch lever 111 returns to the original position by the force of gravity. Therefore, the sensor lever 112 also returns to the original position and blocks the light radiated from the LED 113*a* from being received at the photo diode 113*b*, and thus the sensing signal is no longer output.

An align lever 114 is disposed opposite to the touch lever 111 having the same design as the touch lever 111. The align lever 114 is provided to align the discharged papers 10, Referring to FIG, 4, when normal A4 paper (210 mm×297 mm) is discharged, it touches the touch lever 111 without fail, and accordingly the sensing signal is output. However, if narrow width paper (70 mm×297 mm) is discharged, it will not touch the touch lever 111, By making the distance between the touch lever 111 and the align lever 114 exceed 70 mm or disposing only the touch lever 111 more than 35 mm away from the center of the discharger 150, only papers having a specific width will touch the touch lever 111.

Figure 5:
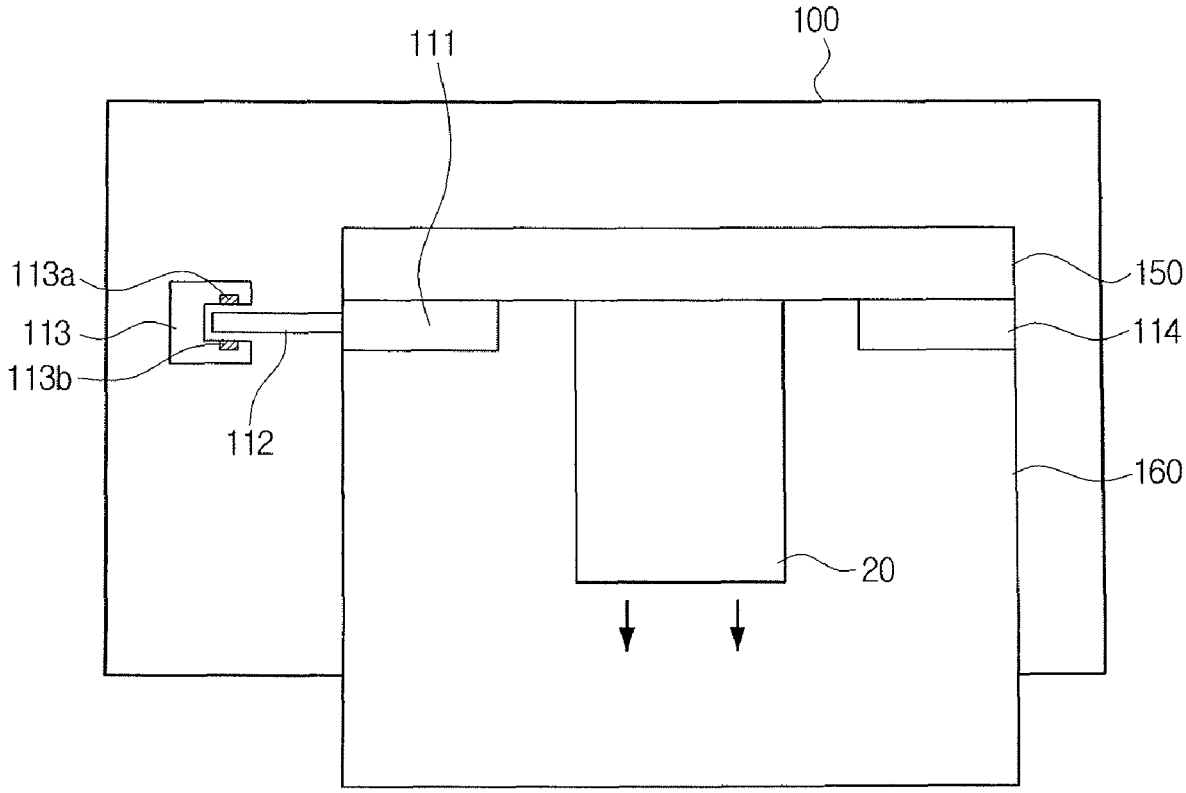

FIG. 5 is a diagram illustrating a narrow width paper being output in the image forming device 100 illustrated in FIG. 4. Referring to FIG. 5, the narrow width paper 20 is discharged from the middle of the discharger 150. Hence, the discharged paper 20 does not touch the touch lever 111, and consequently no sensing signal is output. Since no sensing signal is output, the determiner 120 determines that the narrow width paper 20 is being used.

The discharging location of the narrow width paper 20 may differ depending on the type of paper used. Although FIG. 5 illustrates the image forming device 100 discharging the narrow with paper 20 from the middle of the discharger 150, the paper 20 can also be disposed in alignment with one side of the discharger 150. In this case, the touch lever 111 will be disposed at another location of the discharger 150, that is, at a location where the narrow width paper 20 will not contact the touch lever 111. For instance, if the narrow width paper 20 is disposed in alignment with the left side of the discharger 150, the positions of the align lever 114 and the sensor 110 may be switched so that the narrow width paper 20 is not in contact with the touch lever 111 of the sensor 110.

In accordance with another embodiment of the present general inventive concept, a separate sensor can be combined with the align lever 114. In this case, the determiner 120 determines that the paper 10 has a normal width when sensing signals are output from both of the sensor 110 and the additional sensor combined with the align lever 114, and determines that the paper 20 has a narrow width when the sensing signal is output from only one or neither of the two sensors.

Although the sensor 110 has been described in FIGS. 4 and 5 as being a photo sensor, the sensor 110 may also be implemented in various forms such as a mechanical switch.

Figure 6:
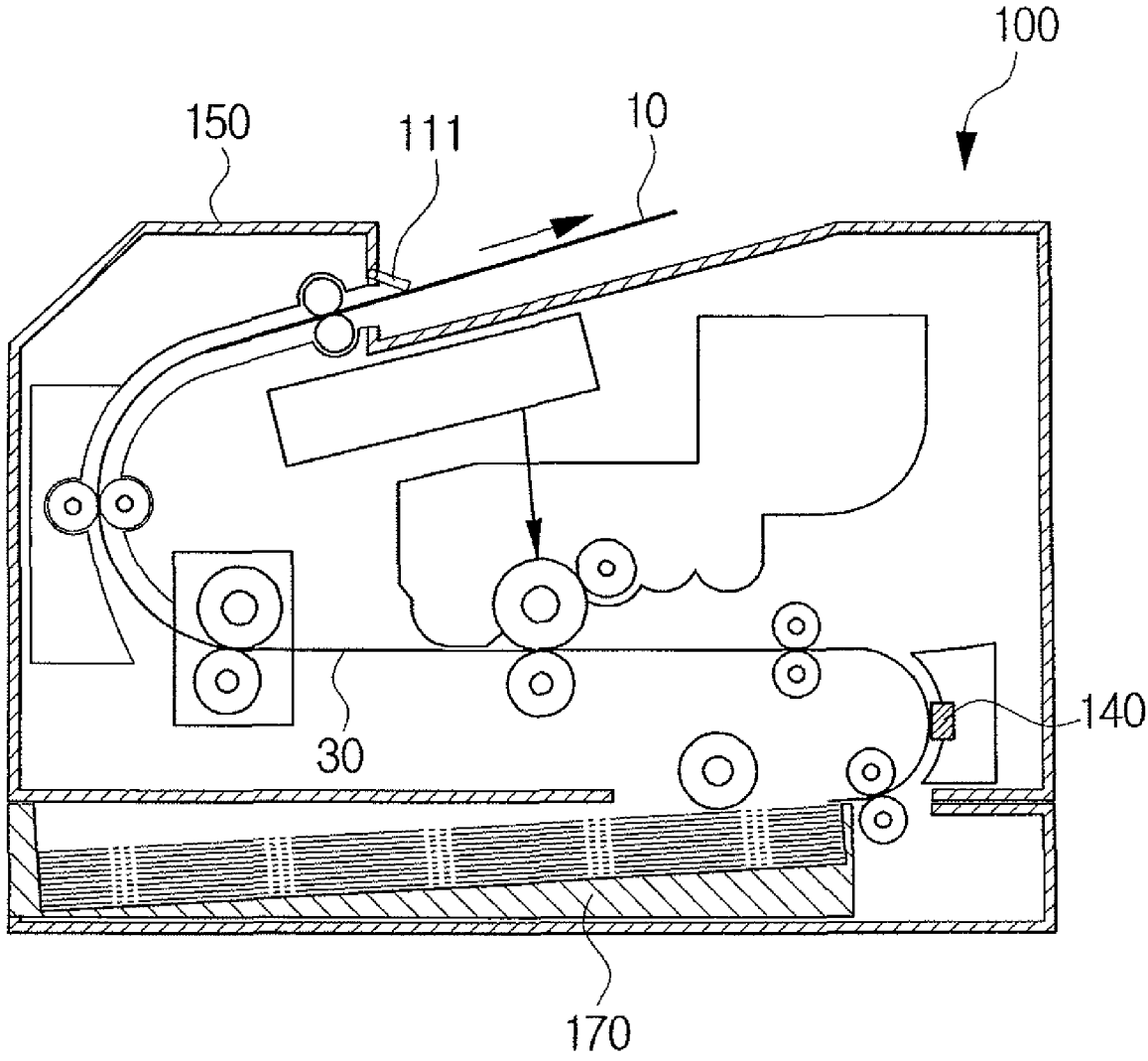
FIG. 6 is a diagram illustrating a paper delivery path and a delivery sensor location according to in the image forming device in accordance with the embodiment of FIG. 2.

FIG. 6 is a diagram illustrating a paper delivery path and the location of the delivery sensor 140 in the image forming device 100 of the embodiment of FIG. 2. As illustrated in FIG. 6, papers 10 are fed from a paper tray 170 and delivered along a delivery path 30. In a laser image forming device 100, the papers 10 go through the printing processes such as charging, exposure, development, transferring, and fusing along the delivery path 30 during the delivery of the paper 10. After the printing processes of the laser image forming device 100 are complete, the papers 10 are discharged through the discharger 150. The discharged papers may or may not touch a touch lever 111 of a sensor 110 depending upon the width of the papers 10.

The delivery sensor 140 is disposed at one section of the delivery path 30 to detect whether the papers 10 are delivered. When a sensing signal is not output from the sensor 110 within a preset time, the preset time being measured from the time point when a delivery sensing signal is output from a delivery sensor 140, the determiner 120 determines that the papers 10 have a narrow width.

Figure 7:
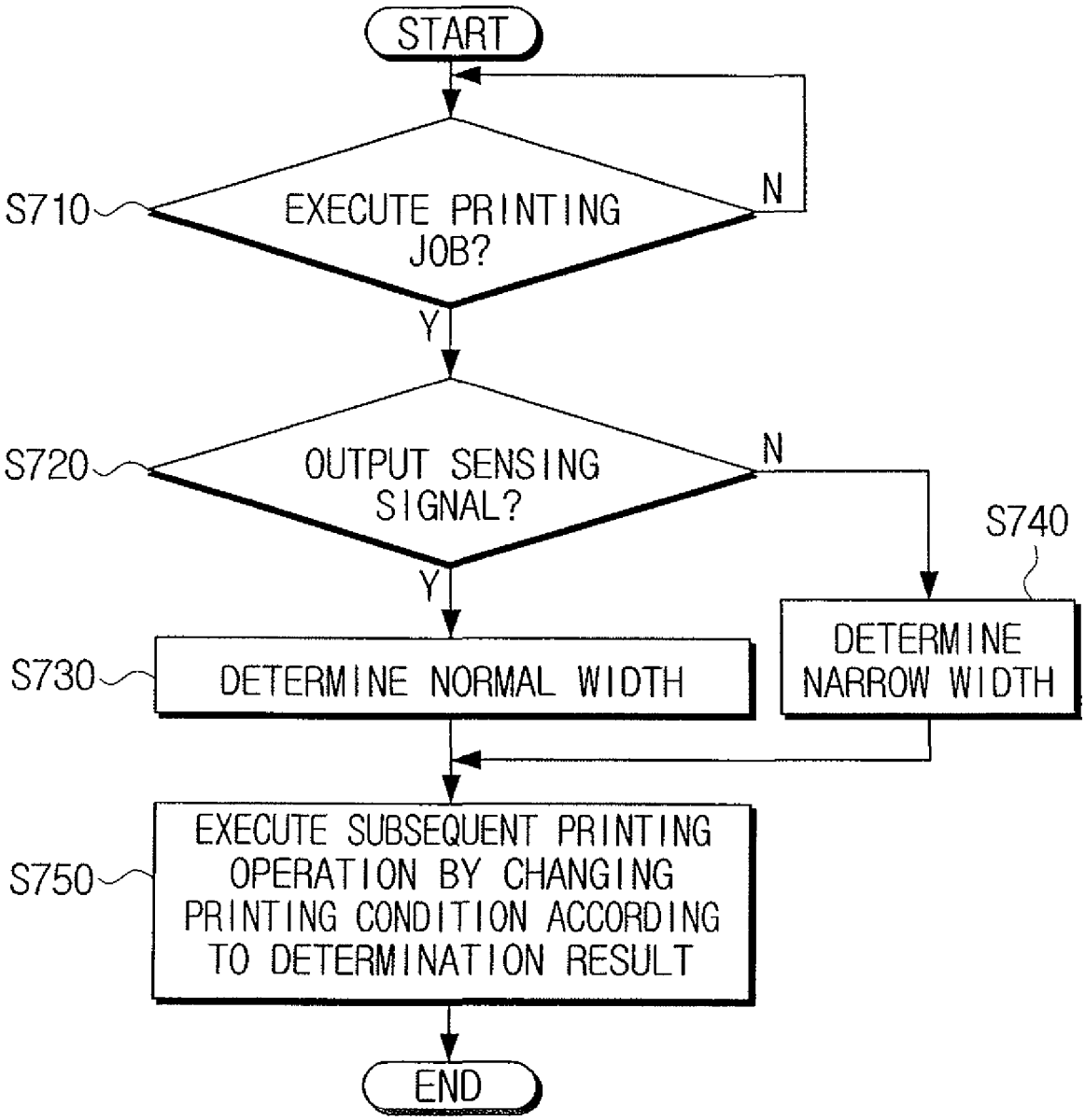
FIG. 7 is a flowchart illustrating an image forming method of the image forming device according to the embodiment of FIG. 1.

FIG. 7 is a flowchart illustrating an image forming method of the image forming device of FIG. 1, according to an embodiment of the present general inventive concept. As illustrated in FIG. 7, when a printing job is initiated (operation S710), whether the sensing signal is output is checked (operation S720). Whether the sensing signal is output is consistently checked for a preset time. When no sensing signal is output until after the preset time elapses (operation S720-N), the paper is determined to have a narrow width (operation S740) and a subsequent printing operation is executed by applying a paper process that corresponds to the narrow width paper, according to the determination result (operation S750). Specifically, the subsequent printing jobs can be processed by lowering the printing conditions such as print speed, fuser temperature, and fuser pressure to preset values.

Alternatively, when the sensing signal is output (operation S720-Y), the paper is determined to have a normal width (operation S730) and the subsequent printing operation is executed by applying the normal paper width process (operation S750). More specifically, the subsequent printing jobs are processed using the default printing conditions that are preset in a printer driver program.

Consequently, without an additional structure, the appropriate printing operation can be carried out by easily detecting a paper width by use of an existing sensor disposed within the image forming device.

As set forth above, the paper width can be detected using a sensor. Since the printing operation is carried out by applying an appropriate printing condition according to a paper width, component damage and printing quality degradation can be avoided. Furthermore, without the use of an additional sensor, the existing sensor is utilized to detect the paper width, thus lowering product costs.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image forming device comprising:

a sensor disposed at one side of a discharger to detect whether a printed paper is discharged and to output a sensing signal when the paper contacts the sensor, the sensor including a touch lever that moves when a first width of the printed paper is discharged, and which does not move when a width other than the first width of the printed paper is discharged;

a determiner to determine a printed paper width according to whether the sensing signal is output within a preset time from the sensor when a printing job is executed; and a controller to control a subsequent printing operation according to the determination result of the determiner.

2. The image forming device of claim 1, wherein, after the printing job is initiated, the determiner determines the printed paper to have a normal width when the sensing signal is output within a preset time, and the determiner determines the printed paper to have a narrow width when the sensing signal is not output within the preset time.

3. The image forming device of claim 1, wherein the controller maintains a print speed, a fuser temperature, and a fuser pressure as default values when the determiner determines the printed paper width is a normal width, and the controller executes the subsequent printing by decreasing at least one of the print speed, the fuser temperature, and the fuser pressure to a preset value when the printed paper width is determined to be the narrow width.

4. The image forming device of claim 1, wherein the discharger discharges the printed paper, the sensor outputs the sensing signal upon being touched by a normal width sheet of printed paper, which is discharged from the discharger, and the sensor does not output a sensing signal when not touched by a narrow width sheet of printed paper, which is discharged from the discharger.

5. An image forming device comprising:

a sensor disposed at one side of a discharger to detect whether a printed paper is discharged and to output a sensing signal when the paper contacts the sensor;

a determiner to determine a printed paper width according to whether the sensing signal is output within a preset time from the sensor when a printing job is executed;

a controller to control a subsequent printing operation according to the determination result of the determiner; and a delivery sensor disposed in a delivery path of a paper to detect whether the paper is delivered from a paper tray, wherein the determiner determines a normal width when the sensing signal is output within a preset time from a time point when a delivery sensing signal is output from the delivery sensor, and the determiner determines a narrow width when the sensing signal is not output within the preset time.

6. An image forming method of an image forming device having a sensor disposed at one side of a discharger to detect whether a printed paper is discharged and to output a sensing signal when the printed paper contacts the sensor, the sensor including a touch lever that moves when a first width of the printed paper is discharged, and which does not move when a width other than the first width of the printed paper is discharged, the method comprising:

determining a printed paper width according to whether the sensing signal is output within a preset time from the sensor when a print job is initiated; and executing a subsequent printing operation according to the determination result.

7. The image forming method of claim 6, wherein, after the print job is initiated, the determining of the printed paper width determines a normal width when the sensing signal is output within a preset time and determines a narrow width when the sensing signal is not output within the preset time.

8. The image forming method of claim 7, wherein the executing of a subsequent printing operation maintains a print speed, a fuser temperature, and a fuser pressure as default values when the normal width is determined, and executes the subsequent printing by decreasing at least one of the print speed, the fuser temperature, and the fuser pressure to a preset value when the narrow width is determined.

9. The image forming method of claim 6, wherein the determining of the printed paper width determines a width when the presence or non-presence of a sensing signal is determined within an elapsed time from a printing job execution time point.

10. The image forming method according to claim 9, wherein the printing job execution time point includes at least one of receiving a print command from a host personal computer, an issuing of a print command by a video controller to an engine controller, and when a printing module is driven.

11. An image forming method of an image forming device having a sensor disposed at one side of a discharger to detect whether a printed paper is discharged and to output a sensing signal when the printed paper contacts the sensor, the method comprising:

determining a printed paper width according to whether the sensing signal is output within a preset time from the sensor when a print job is initiated; and executing a subsequent printing operation according to the determination result, wherein the determining of the printed paper width determines a normal width when the sensing signal is output within a preset time from a time point when a delivery sensing signal is output from a delivery sensor which is disposed in a delivery path of a paper to detect whether the paper is delivered, and determines a narrow width when the sensing signal is not output within the preset time.

12. An image forming device, comprising:

a sensor disposed at one side of a discharger to sense a width of a recording medium being discharged from a predetermined point within the image forming device, the sensor including a touch lever that moves when a first width of the printed paper is discharged, and which does not move when a width other than the first width of the printed paper is discharged, the sensor providing a signal when a first width is detected, and not providing a signal when a width other than the first width is detected; and a controller to selectively adjust subsequent printing conditions in response to the sensed width of the recording medium.

13. The image forming device of claim 12, wherein the width result corresponds to a narrow width or a normal width of the recording medium.

14. The image forming device of claim 13, wherein the sensor comprises:

a touch lever to move according to a width of the recording medium; and a sensing part to sense when the touch lever has moved.

15. An image forming device, comprising:

a sensor disposed at one side of a discharger to sense a width of a recording medium being discharged from a predetermined point within the image forming device, the sensor providing a signal when a first width is detected, and not providing a signal when a width other than the first width is detected;

a controller to selectively adjust subsequent printing conditions in response to the sensed width of the recording medium;

a delivery sensor disposed in a delivery path of the recording medium to detect whether the recording medium is delivered from a paper tray; and a determiner to determine the width of the recording medium sensed by the sensor according to whether the sensed width of the recording medium is sensed within a preset time from when a printing job is executed.

* * * * *